United States Patent [19]

Johnson

[11] 4,302,009

[45] Nov. 24, 1981

[54] AUTOMATIC LIFT OFF WEIGHT RACK FOR BARBELLS

[76] Inventor: Samuel O. Johnson, 502 Fair Rd., Statesboro, Ga. 30458

[21] Appl. No.: 147,915

[22] Filed: May 8, 1980

[51] Int. Cl.[3] ..... A63B 13/00

[52] U.S. Cl. ..... 272/123; 272/DIG. 4

[58] Field of Search ..... 272/134, 123, 122, 144, 272/117, 116, DIG. 4, 102, 103

[56] References Cited

U.S. PATENT DOCUMENTS 3,118,668 1/1964 Callahan ..... 272/123
4,205,838 6/1980 McIntosh ..... 272/123

FOREIGN PATENT DOCUMENTS 38669 9/1909 Fed. Rep. of Germany ..... 272/102

OTHER PUBLICATIONS

"Adjustable Hurdles", Fred Medart Catalogue, (No. 192) p. 58, 1919.
"Nonpareil", Supine Press Bench, Marcy Catalogue, 1974, p. 45.

*Primary Examiner*—Richard C. Pinkham
*Assistant Examiner*—William R. Browne
*Attorney, Agent, or Firm*—James B. Middleton

[57] ABSTRACT

An automatic rack for barbells is disclosed. The rack includes a pivotal standard that is tiltable to hold a barbell in lifting position; and, when the barbell is removed, a weight biases the standard to pivot to an out-of-the-way storage position. The rack can be provided with a base so the rack will be free standing, or the rack can be fixed to a press bench or the like.

5 Claims, 7 Drawing Figures

AUTOMATIC LIFT OFF WEIGHT RACK FOR BARBELLS

FIELD OF THE INVENTION

This invention relates generally to apparatus for use in exercising, and is more particularly concerned with an automatic lift off rack for use in exercising with barbells.

BACKGROUND OF THE INVENTION

The lifting of barbells is a very popular pastime both as a body building exercise and as a sport in which weight lifters compete to lift the heaviest weight. In the lifting of a barbell, the object is simply to lift the barbell in a predetermined manner, and any additional tasks that must be performed by the lifter will simply detract from his ability to make the desired lift. As a result, it is common in competitive meets to have two people to present the barbell to the lifter when the lifter is in position to lift the barbell. This does away with any additional tasks which would somewhat tire the lifter and not allow him to make his best lift. It will of course be understood that the presentation of a barbell by two people subjects the presentation to variations between lifters.

There have been some racks for supporting a barbell or the like, but it has been almost impossible for a lifter to take the weight from the rack and then make the lift. If the lifter is able to take the weight from the rack, the barbell will hit the rack when the lift is made. Thus, a lifter has been required to have a second person to hand him the barbell; and, again, the presentation of the barbell is subject to variations. Other racks and devices have been provided to assist a weight lifter, but these have frequently been very elaborate structures, sometimes with safety features that may be desirable for a person practicing alone, but they do not provide practice to the standards that will be demanded in competition. Such devices are also generally quite complex, rendering them difficult and expensive to manufacture so that only well equipped gymnasiums or the like would generally have such equipment.

SUMMARY OF THE INVENTION

The present invention overcomes the above mentioned and other difficulties with the prior art by providing a weight lifting device having a shiftable rack. The barbell to be lifted can be mounted on the rack at the appropriate height for a given lifter. Preparatory to making the lift, the rack can be shifted to place the barbell in the precise position to be lifted; then, the lifter will take his position with respect to the apparatus, grasp the barbell, lift the barbell slightly, and the rack will return to a storage, or out-of-the-way, position allowing the lifter to make a lift in accordance with regulations. At the end of the lift, the lifter can swing the barbell slightly rearwardly where the barbell will once again be engaged by the rack, and the barbell will be stored on the rack with the rack in its storage position. The present invention therefore provides a rack for a barbell, the rack being shiftable to a lifting position, and the rack being automatically retractable to its storage position, the rack remaining adjacent to the lifter to receive the barbell following the ift.

BRIEF DESCRIPTION OF THE DRAWINGS

These and other features and advantages of the present invention will become apparent from consideration of the following specification when taken in conjunction with the accompanying drawings in which.

DESCRIPTION OF THE PREFERRED EMBODIMENT

Figures 1, 2, 3, 4, 5, 6, 7:
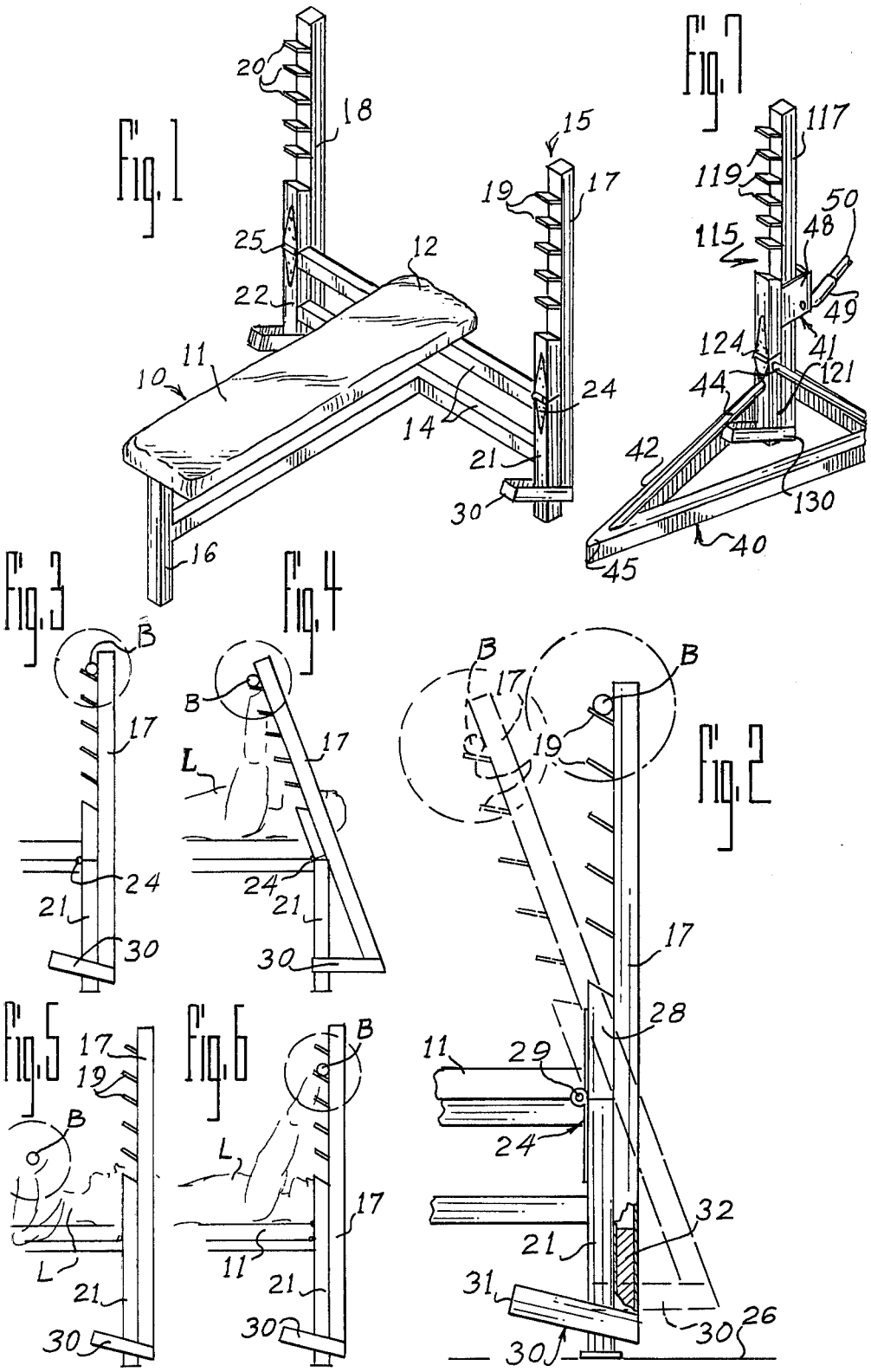
FIG. 1 is a perspective view of a press bench having racks thereon made in accordance with the present invention.
FIG. 2 is an enlarged, partial side elevational view of a rack as shown in FIG. 1.
FIG. 3–6 are somewhat schematic views showing the sequence of operation of the rack of the present invention; and, FIG. 7 is a perspective view of a modified form of a rack made in accordance with the present invention.

Referring now more particularly to the drawings, and to those embodiments of the invention here presented by way of illustration, FIG. 1 discloses a press bench generally designated at 10 having a padded surface 11 for receiving a lifter. The press bench 10 has a head end 12 which is supported by cross members 14 between the barbell racks generally designated at 15. The opposite end of the press bench 10 is provided with an appropriate leg 16. While necessary supporting structure for the press bench 10 is here shown, it will be understood that such support structure is conventional and other structure could be used equally well with the present invention.

The pair of barbell racks 15 shown in FIG. 1 includes a pair of standards 17 and 18, these standards 17 and 18 having a plurality of shelves 19 and 20 extending therefrom respectively.

It will be seen that the standards 17 and 18 are mounted rearwardly of support members 21 and 22 which have the cross members 14 attached thereto. At the upper end of each of the support members 21 and 22, there is a hinge designated at 24 and 25. As will be discussed in more detail hereinafter, the shelves 19 and 20 are adapted to receive a barbell; and, the standards 17 and 18 can rest in the position shown in FIG. 1, which is the storage position, or the standards 17 and 18 can pivot about the hinges 24 and 25 to place the barbell in its lifting position.

Attention is directed to FIG. 2 of the drawings which shows the structure of one of the racks 15 in more detail. FIG. 2 of the drawings is a side elevational view of the standard 17 and the supporting member 21 to which the standard 17 is attached. It will here be seen that the support member 21 is as a leg to engage the floor or other supporting surface 26, and the cross members 14 extend between the support members 21 and 22 to carry the press bench 10. The standard 17, then, extends parallel to, and substantially contiguously with the support member 21 when the standard 17 is in its storage position.

The standard 17 has a block 28 fixed thereto, the block 28 being the same thickness as the support member 21. The hinge 24 is attached to the block 28 and to the support member 21 so that the pintle, or hinge axis, 29 is generally aligned with the front surface of the support member 21, or somewhat beyond the front surface. It will be understood by those skilled in the art that the particular arrangement here shown is a convenient means for disposing the pintle 29 in the desired location, though other mechanical arrangement can be used equally well.

It will also be seen in FIG. 2 of the drawings that the shelves 19 are sloped somewhat upwardly so that a barbell, represented by the circle indicated at B, will be quite stable when in place on the shelf 19, the barbell B being confined between the shelf 19 and the front surface of the standard 17.

With the barbell B placed on the shelf 19, and the standard 17 in its storage position as shown in full lines in FIG. 2, it will be seen that the weight of the barbell will effectively act from the centerpoint of the barbell B. This places the center of gravity of the barbell rearwardly of the pintle 29 of the hinge 24. While the distance between the center of gravity of the barbell B and the axis of the hinge 24 is quite small, which is to say there is a short lever arm, it will be understood that the barbell B will be quite heavy so the total force tending to rotate the standard 17 in a clockwise direction will be reasonably large.

With the foregoing in mind, and looking now at the broken line representation in FIG. 2 of the drawings, it will be understood that the standard 17 can be intentionally caused to pivot about the pintle 29. The lowermost end of the standard 17 is provided with a stop member 30 to limit the forward motion of the barbell B as the standard 17 is caused to pivot. As here shown, the stop means 30 includes a loop fixed to the lower end of the standard 17 and extending around the lowermost end of the support member 21. As a result, the standard 17 can be pivoted until the end piece 31 of the stop member 30 engages the support member 21. This extreme position is indicated in broken lines in FIG. 2. With the standard 17 so tilted, the barbell B is well forward of the pintle 29 so the barbell B causes a counterclockwise torque. Again, remembering the weight of the barbell B, the torque is sufficient to retain the standard 17 in its tilted position.

Attention is again directed to the shelves 19. It will be seen that the upward tilt of the shelves 19 is such that, when the standard 17 is in its tilted position as shown in broken lines, the shelves 19 are still tilted somewhat upwardly so that the barbell B is adequately retained on a shelf 19. Though angles and dimensions may vary depending on the particular press bench made, and the particular weight involved, it is contemplated that the barbell B can be lifted approximately 0.2 inch or about 0.5 centimeter for the barbell to clear the end of the shelf 19.

When the barbell B is lifted from the shelf 19, the standard 17 needs to return to its storage position as shown in full lines in FIG. 2. To assist in this return, there is here shown a weight 32 in the lower end of the standard 17. While a biasing means may be provided in many different ways, the standard 17 is here shown as being constructed of a square tubular member, and the weight 32 is provided simply by filling the lower end of the standard 17 with lead or other heavy material.

With the foregoing description in mind, attention is now directed to FIGS. 3 through 6 of the drawings for a full understanding of the device. Looking first at FIG. 3 of the drawings it will be seen that the racks 15 have been loaded with a barbell B, the standards 17 and 18 being in their storage position. Before the lifter takes his position on the press bench 10, the lifter would urge the upper portion of the standards forwardly, or in a counterclockwise direction as viewed in the drawing. This would cause the standards to pivot about the pintles such as the pintle 29 so that the rack 15 would assume the position shown in FIG. 4 of the drawings. In FIG. 4 it will be seen that the lifter, designated at L, is in position on the press bench 10, and the barbell B is disposed generally over the lifter's chest in lifting position. The lifter then grasps the barbell and lifts slightly. This slight lifting disengages the barbell B from the shelves 19 and 20 so that the standards are free to rotate under the influence of the biasing device such as the weight 32. The standard 17 therefore returns to its storage position as shown in FIG. 5 while the lifter L can make the conventional lift.

The lifter finishes his lift with the barbell held straight up above his chest. With the barbell in this position, it will be seen that the lifter can allow his arms to swing rearwardly of the press bench 10, and the barbell will once again engage the shelves 19 and 20 on the racks 15. Since the standards 17 and 18 are in their storage position, it will be remembered that the weight of the barbell B acts rearwardly of the pintle 29 so that the barbell creates a clockwise torque tending to hold the racks 15 in their storage position.

It will therefore be seen that the apparatus of the present invention provides a press bench having a barbell rack so arranged that one person can use the press bench for lifting in the same way as if he were in competition. The barbell can be placed on the shelves 19 and 20 with the racks in the storage position, and a plurality of the shelves 19 and 20 are provided so that the barbell can be disposed at the appropriate height for any given lifter. With the barbell in place, before the lifter assumes his position on the press bench, the standards 17 and 18 will be rotated by means of the hinges 24 and 25 so that the barbell will be disposed in such a location as to be above the lifter's chest when the lifter assumes his position on the press bench. The lifter then takes his position on the press bench, reaches straight up and lifts the barbell only slightly so that the barbell is disengaged from the shelves 19 and 20. Biasing means 32 then cause the standards 17 and 18 to rotate to their storage position, and the lifter has the weight and can make the appropriate lift. At the end of the lift, the lifter can simply swing his arms somewhat rearwardly and the barbell will once again engage the shelves 19 and 20 on the rack 15.

Attention is now directed to FIG. 7 of the drawings which discloses a slightly modified form of the device of the present invention.

While the device presented in FIGS. 1–6 includes a bench having a pair of racks 15 fixed thereto, there are some situations in which no bench or the like is required. One such situation is the lifting of a barbell from the squatting position. The squat lift is performed while squatting on the floor, and the barbell is placed across the lifter's back, on his shoulders. Thus, the device shown in FIG. 7 of the drawings comprises a single rack having a base member 40 to maintain the rack in upright position.

The overall structure of the device 115 shown in FIG. 7 is similar to one of the racks 15 shown in FIG. 1; and, it will be understood by those skilled in the art that two of the racks shown in FIG. 7 will be used to support a barbell for lifting, but each of the racks 115 is free standing.

Thus, the rack 115 includes a standard 117 having a plurality of shelves 119 to receive a barbell. A support member 121 carries the hinge 124 to allow the standard 117 to pivot. Further, there is a stop means 130 to limit pivoting motion of the standard 117.

There are two features of the rack 115 that are not included in the previously described embodiment. One of these features is the base member 40, and the other is the vertical adjustment device 41.

The base member 40 is of generally conventional construction including a triangular frame 42. Struts 44 extend from the upper portion of the support member 121 to the three corners of the frame 42. Thus, a tripod arrangement is provided to mount the supporting member 121 and give the required stability.

The vertical adjustment device 41 has a housing 48 fixed to the support member 121 with the standard 117 vertically movable therein. It is contemplated that the mechanism will be a conventional jack or other such lifting mechanism well understood by those skilled in the art, and no details of construction are thought to be necessary. The device includes the receptacle 49 for receiving an operating handle 50 as is conventional.

It will therefore be seen that the arrangement shown in FIG. 7 of the drawings provides a convenient rack for supporting a barbell, and includes the same automatic lift off feature as the rack 15 shown in FIG. 1. The rack 115 of FIG. 7 is somewhat more versatile, and could of course be used in conjunction with a bench or the like if desired.

It should be observed that the orientation of the base 40 is such that the lifter will squat adjacent to the apex of the triangular frame 42, the frame 42 being in the form of an isosceles triangle. While the principal object is simply to support the racks, the arrangement prevents interference with the lifter while giving enough support in the direction of the large forces.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as defined in the appended claims.

I claim:

1. A barbell rack for receiving a barbell preparatory to lifting, said rack including a standard having a lifting position and a storage position, support means for supporting said standard, hinge means for pivotally fixing said standard to said support means, and stop means for limiting pivotal motion of said standard with respect to said support means, said standard further including shelf means for supporting a barbell on said standard, said storage position being a position wherein said standard is generally vertical and a barbell carried thereby biases said standard towards said storage position, and said lifting position being a position wherein said standard is tilted and a barbell carried thereby biases said standard towards said lifting position.

2. A barbell rack as claimed in claim 1, said standard further including biasing means for biasing said standard towards said storage position, said biasing means being such as to be overcome by said barbell when said standard is in said lifting position.

3. A barbell rack as claimed in claim 2, said rack being one of a pair of barbell racks, a press bench between said pair of barbell racks, means for supporting said press bench and connecting said press bench to said pair of barbell racks, said support means constituting two legs for said press bench.

4. A barbell rack as claimed in claim 3, said lifting position being such that a barbell carried by said pair of barbell racks will be disposed generally over the chest of a lifter in position on said press bench, said storage position being out-of-the-way for a lift and such that said lifter can place said barbell on said pair of barbell racks after said lift.

5. A barbell rack as claimed in claim 2, said shelf means being so angled with respect to said standard that a barbell will be held by said shelf means in both the storage position and the lifting position.

* * * * *